US007551080B2

(12) United States Patent
Bergman et al.

(10) Patent No.: US 7,551,080 B2
(45) Date of Patent: Jun. 23, 2009

(54) CONTROL FOR EMBEDDED AND DOOR-MOUNTED ANTENNAS

(75) Inventors: Adam Scott Bergman, Boca Raton, FL (US); Jack Howard Schneider, Coral Springs, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 295 days.

(21) Appl. No.: 11/487,651

(22) Filed: Jul. 17, 2006

(65) Prior Publication Data

US 2008/0018474 A1 Jan. 24, 2008

(51) Int. Cl.
*G08B 13/08* (2006.01)

(52) U.S. Cl. ..... 340/545.1; 340/539.1; 340/541; 340/551; 340/552; 340/572.7; 340/572.8; 340/10.1

(58) Field of Classification Search ..... 340/545.1, 340/545.6, 539.1, 541, 551, 552, 572.1, 572.3, 340/572.7, 572.8, 825.69, 10.1, 10.34; 235/380, 235/383, 487

See application file for complete search history.

(56) References Cited

U.S. PATENT DOCUMENTS

| | | | | |
|---|---|---|---|---|
| 4,009,476 | A * | 2/1977 | Lutz | 342/61 |
| 4,394,645 | A | 7/1983 | Humble et al. | |
| 5,276,430 | A * | 1/1994 | Granovsky | 340/572.4 |
| 6,114,956 | A | 9/2000 | Van Genechten | |
| 6,549,119 | B1 * | 4/2003 | Turner | 340/10.5 |
| 7,075,441 | B2 * | 7/2006 | Tsukamoto | 340/572.8 |
| 2005/0046572 | A1 * | 3/2005 | Hader | 340/572.7 |

FOREIGN PATENT DOCUMENTS

DE 9416490.8 U1 2/1995

OTHER PUBLICATIONS

Written Opinion of the International Search Report dated Feb. 1, 2008 for PCT/US2007/016244, International Filing Date Jul. 16, 2007 consisting of 12-pages.

* cited by examiner

*Primary Examiner*—Hung T. Nguyen
(74) *Attorney, Agent, or Firm*—Christopher & Weisberg, P.A.

(57) ABSTRACT

A system and method for controlling door-mounted or door-embedded antennas. An antenna, for example, an EAS or an RF antenna, sends interrogation signals which are received by markers located on merchandise within a range of detection, i.e., an "interrogation zone". Antennas that are mounted on or embedded in a door move along with the motion of the door. Thus, the interrogation zone covered by the antenna's magnetic field is continually changing with the movement of the door. The system and method of the present invention control door-mounted antennas by monitoring the motion of the door upon which the antenna is mounted, and by adjusting the size and breadth of the interrogation zone generated by the antenna accordingly. A processor within a control unit receives positional signals from a position sensor mounted on the moving door, determines whether the interrogation zone should be increased, decreased, shut off, or maintained, and transmits signals to the antenna or to an alarm device, the signal containing interrogation zone modification instructions.

13 Claims, 8 Drawing Sheets

CONTROL FOR EMBEDDED AND DOOR-MOUNTED ANTENNAS

CROSS-REFERENCE TO RELATED APPLICATIONS n/a

STATEMENT REGARDING FEDERALLY SPONSORED RESEARCH OR DEVELOPMENT n/a

BACKGROUND OF THE INVENTION

1. Statement of the Technical Field

The present invention relates to merchandise surveillance systems and more particularly to a system and method for monitoring the position of a door-mounted antenna, and altering the interrogation zone created by the antenna, depending upon the angle which the door containing the antenna is positioned relative to a reference plane.

2. Description of the Related Art

In a surveillance system, antennas such as EAS ("Electronic Article Surveillance") antennas or RF (Radio Frequency) antennas, transmit interrogation signals that are received by markers such as Radio Frequency ID (RFID) or magneto acoustic markers located on merchandise within an establishment. The markers send corresponding signals back to the antenna. Thus, the interaction between the antennas and the markers establish an interrogation zone that can provide an establishment, such as a retail store, with a security system for its merchandise. Conventional surveillance systems include antennas located in a pedestal, the floor, the ceiling or wall or a combination of each such that the antennas can be used to monitor a large volume with the minimum number of antennas. While these types of systems are fine for large department stores and supermarkets, small shop retailers have different concerns since their security budgets may be lower and floor space may be at a great premium.

One solution to the aforementioned problem faced by small retail stores is to mount one or more antennas on a swinging or sliding door. This allows retailers to utilize valuable floor, wall and/or counter space of merchandise, while still maintaining a security system. However, a problem that arises with this solution is that when the door is opened, the door-mounted antenna moves, and the resulting detection zone that is generated by the antenna also moves, possibly resulting in areas that now become out of reach of the antenna's detection zone. This is not a desired result in a small store that needs merchandise as close to the door exists as possible.

A problem that arises when antennas are mounted on moving doors is that as the door is opening or closing, the antenna also moves, thus altering the originally-designed interrogation zone. The resulting location of the antenna may result in an over-range or an under-range condition. An over-range condition occurs when the magnetic field from the antenna covers a range of areas that includes locations where detection coverage is not needed. For example, a customer should be allowed to wait on line and approach a register holding an item having a marker without an alarm being set because the marked item has moved within the interrogation zone. This might occur when a door is swung into the store by the entrance of a new customer, and/or the exit of an existing customer, and the range of the magnetic field radiating from a door-mounted EAS antenna, or the range of RF signals transmitted by an RF antenna, which is moving along with the swinging door, coincides with the signal transmitted by the marker on an item being purchased by another customer on a check-out line. An over-range situation may also occur when the line for the cash register passes by an interrogation zone, or when a sliding door with an antenna moves laterally, moving marked items into the interrogation zone.

An under-range condition occurs, for example, when a customer is exiting the store by swinging the door outward. In this case, because the antenna has moved along with the door, its interrogation zone may not cover a marked item near the exit of the store. Thus, a shoplifter who is approaching the door with a marked item when the door is opened by a new customer or an existing customer exiting the store, will not trigger an alarm since the door upon which the alarm is mounted has been swung outward, and the unadjusted magnetic field no longer coincides within signal transmitted by the marked item.

Therefore, what is needed is a method and system that determines when a door containing an antenna is opened, in which the angle that the door is opened is monitored and measured with respect to a given reference plane, and controls the interrogation zone of the antenna to account for over-range and under-range conditions.

SUMMARY OF THE INVENTION

The present invention addresses the deficiencies in the art with respect to door-mounted antennas. An antenna sends interrogation signals which are received by makers located on merchandise within a range of detection, i.e., an "interrogation zone". The markers send corresponding signals back to the antenna. Antennas that are mounted on a door move along with the motion of the door. Thus, the interrogation zone covered by the antenna's magnetic field varies with the movement of the door. In some instances, an over-range or under-range condition is the result. In this regard, the system and method of the present invention are arranged to control door-mounted antennas by monitoring the motion of the door upon which the antenna is mounted, and by adjusting the size and breadth of the interrogation zone generated by the antenna accordingly. A processor within the controller receives positional signals from a position sensor mounted on the moving door, determines whether the interrogation zone should be increased, decreased, shut off, or maintained, in order to provide maximum store security subject to the store's size and physical and space limitations, and transmits signals to the antenna or to an alarm device, the signal containing interrogation zone modification instructions.

According to one aspect, a method of controlling the interrogation zone of a door-mounted antenna is provided. The antenna includes a transmitter component and a receiver component. The method includes monitoring the movement of a door upon which the antenna is mounted, determining a distance that the door is moved in relation to a reference plane, and providing interrogation zone instructions based upon the distance that the door has been moved in relation to the reference plane.

According to another aspect, the present invention provides a system for controlling the interrogation zone of a door-mounted antenna. The system includes a door-mounted antenna having a transmitter component and a receiver component, and a sensor positioned proximate the door upon which the antenna is mounted. The sensor determines a distance that the door is moved in relation to a reference plane and transmits positional signals representative of this distance. The system also includes a control unit having a power supply, signal receiver circuitry for receiving positional signals from the sensor, a processor for providing interrogation zone modification instructions based upon the received positional signals, and signal transmission circuitry for transmitting signals, where the signals include the interrogation zone modification instructions.

According to still another aspect, the present invention provides a sensor for use with a merchandise interrogation system. The system includes an antenna mounted to a movable door and a control unit having a processor for determining interrogation zone modification instructions. The sensor includes a sensing module for determining a distance that the door is moved in relation to a reference plane, and a transmitting module for transmitting positional signals representative of the distance that the door has moved in relation to the reference plane, where the positional signals are used by the control unit to determine interrogation zone modification instructions.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE PREFERRED EMBODIMENTS

Figure 1:
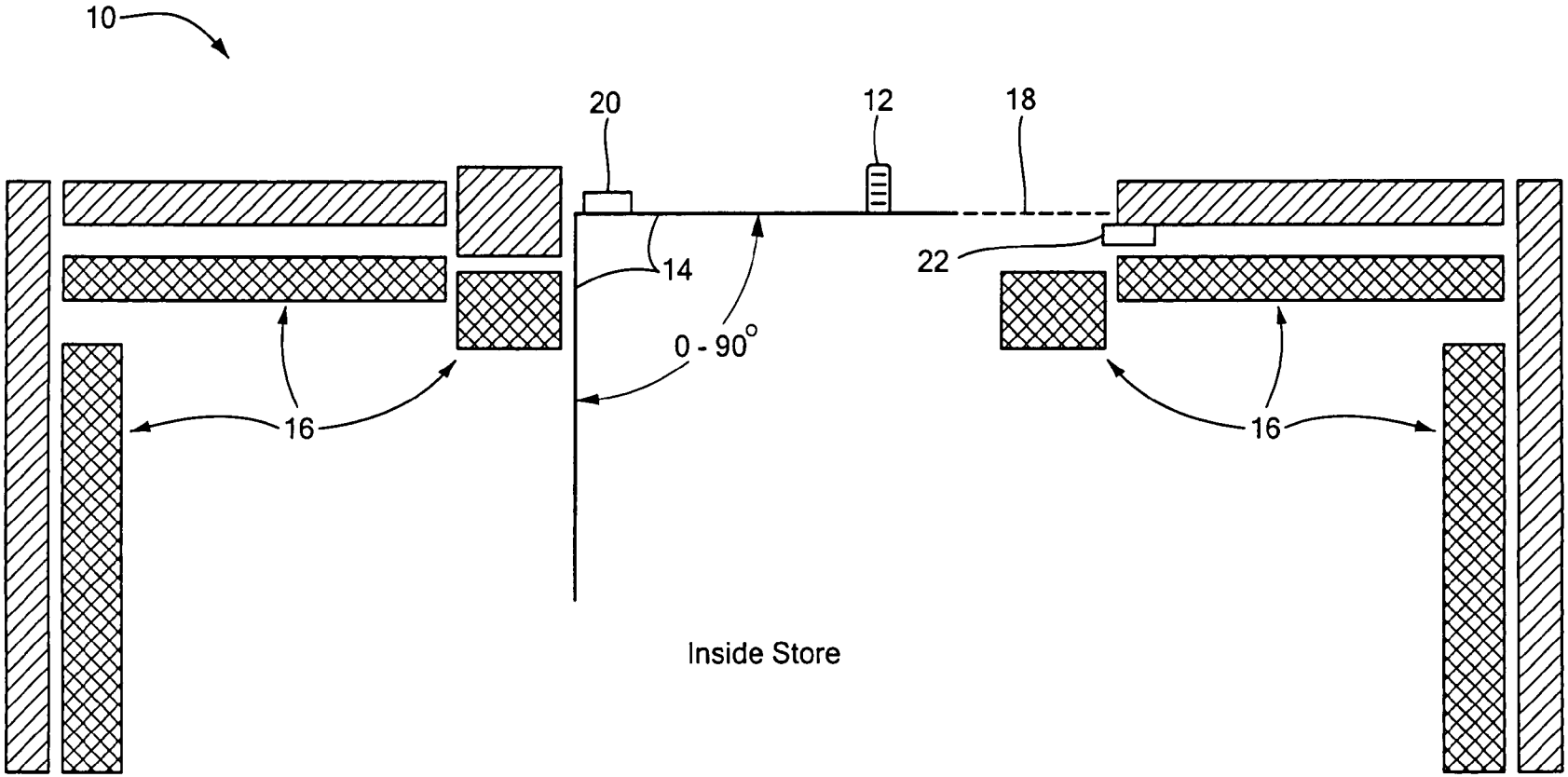
FIG. 1 is a diagram of a door-mounted antenna on a swinging door in accordance with the principles of the present invention.

The present invention advantageously provides a system that controls the interrogation zone created by an antenna mounted on a door, as the door moves throughout a different range of positions with respect to a reference plane. Referring now to the drawing figures in which like reference designators refer to like elements there is shown in FIG. 1 a system constructed in accordance with the principles of the present invention and designated generally as "10." System 10 includes an antenna 12 mounted upon a movable door 14. Antenna 12 can be an EAS antenna, an RF antenna or any other type of antenna that can transmit communication signals to a marker, where the marker can detect the incoming signals. Door 14 can be any type of movable door, i.e., a hinged door or a sliding door. In FIG. 1 door 14 swings via hinges from a closed position, i.e., 0 degrees, to a fully-open position, i.e. 90 degrees. In the embodiment shown in FIG. 1, door 14 swings inward, i.e. into a store. However, the invention is not limited to a door that swings in this fashion, and later embodiments illustrate the system 10 used with a door that swings outward. Further, door 14 may swing in either direction and need not swing in the direction illustrated in FIG. 1. System 10 is also equally compatible with a door that slides.

Antenna 12 may be configured as a transceiver antenna with an associated controller that provides control and switching to switch from transmitting to receiving functions at predetermined time intervals. Those skilled in the art will recognize that there may be a separate transmitting and receiving modules within antenna 12. Antenna 12 emits electromagnetic signals covering a certain interrogation zone. FIG. 1 shows the interior of a typical store or manufacturing facility that uses system 10 of the present invention. Within the interior of the manufacturing facility or retail establishment, various markers are placed on items or assets 16 to be protected within the interrogation zone. If the marker is not removed from the item 16 or deactivated prior to entering the interrogation zone, the electromagnetic field established by antenna 12 will cause a response from the marker. This response is received by the receiving module or the transceiver module of antenna 12.

Antenna 12 may be affixed or mounted to door 14 in a variety of ways, and the invention disclosed herein is not limited to a particular mounting means. For example, antenna 12 may be inserted within a drilled space on the top or side of door 14, integrated within the door, or securely affixed to door 14 in any other manner. Door 14 swings from a closed position (0 degrees) through a range of open positions, relative to a reference plane 18, e.g., the plane of the store wall. A position sensor 20 may be mounted on or near door 14. Sensor 20 detects the movement of door 14 relative to reference plane 18. Sensor 20 may be affixed or mounted to door 14, or be positioned at a location proximate door 14. Sensor 20 may be used in conjunction with another positional device, which may be placed on a non-movable object, such as the door frame. Either alone or in conjunction with a complementary positional device, sensor 20 detects movement of door 20 relative to plane 18. Thus, as door 14 moves through a range of positions, sensor 20 detects this motion as well as the movement of door-mounted antenna 12, which is affixed to and moves in accordance with door 14.

Sensor 20 may be any type of motion detector such as, but not limited to, an angle position sensor, a smart door hinge, or a switch or series of switches that transfers the position or angle of door 14 with respect to plane 18 to a controller 22. In one embodiment, sensor 20 includes a sensing module for determining a distance that the door is moved in relation to a reference plane, and a transmitting module for transmitting positional signals representative of the distance that the door has moved in relation to the reference plane.

Controller 22 may be mounted in any location capable of receiving positional signals from sensor 20 and exchanging communications signals with antenna 12, and/or a store's alarm system, including on door 14 itself. Controller 22 includes a power supply, signal receiving circuitry, signal transmitting circuitry, and a processor. The controller's signal receiving circuitry receives positional information from sensor 20, and the controller's processor compares the information with a table or database of rules, either stored in controller 22, or at a remote location in communication with controller 22. In other words, the processor can execute an algorithm that establishes a detection zone based on the position of door 14 as determined by sensor 20.

Based upon the processor's comparison of the present location of door 14 with the established rules, a correction signal containing interrogation zone modification instructions is transmitted, via the controller's transmitting circuitry, back to the receiving component in antenna 12. In one embodiment, the correction signal may instruct antenna 12 to alter the magnitude of its magnetic field to account for the current position of door 14. The correction signal may instruct antenna 12 to increase, decrease, or maintain the magnitude of the magnetic field, depending upon the location of door 14 as established by the stored rules.

Figure 2:
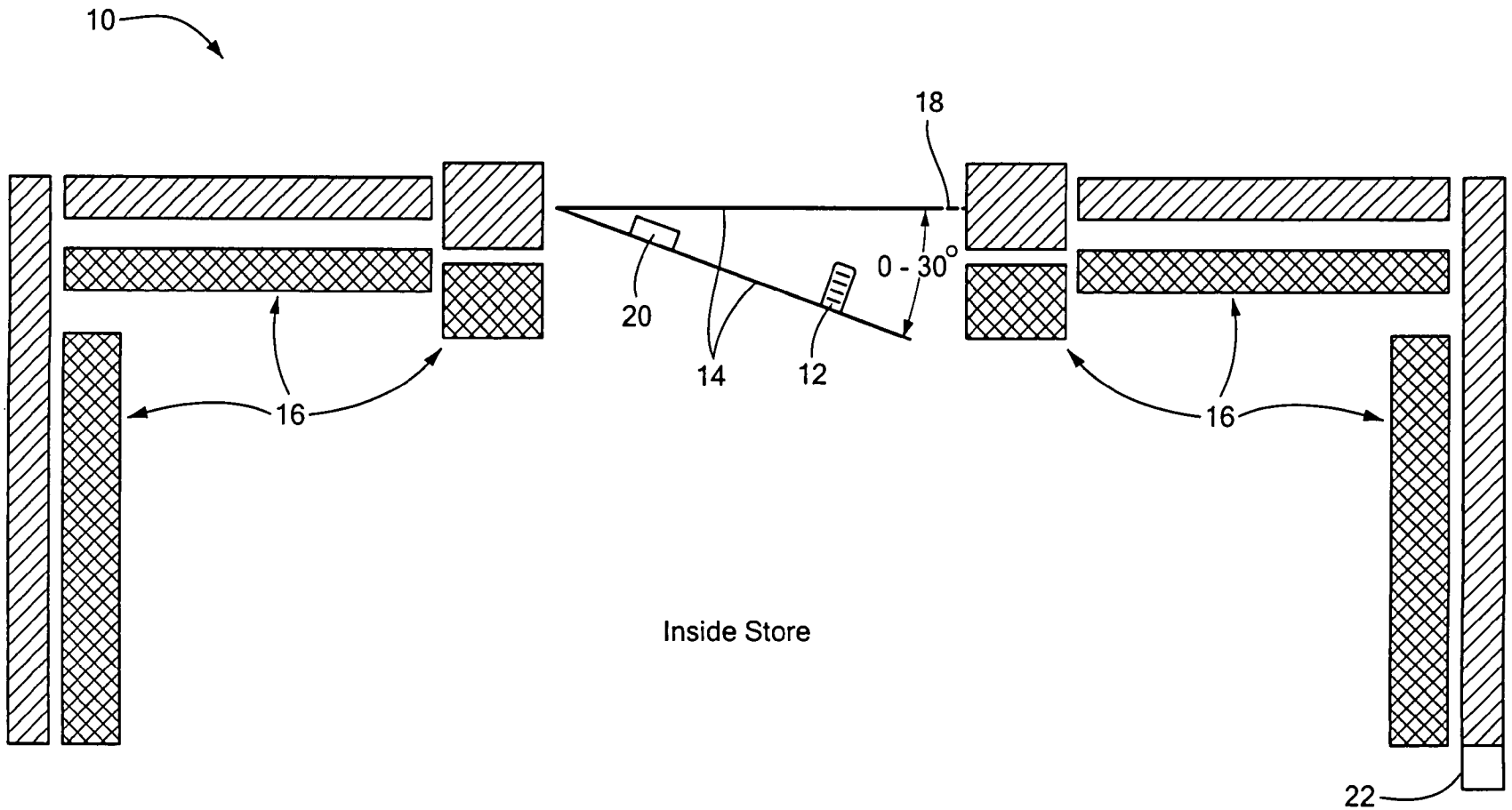
FIG. 2 is a diagram of a door-mounted antenna on a swinging door in accordance with the principles of the present invention, where the door is swung inward at angle between 0 and 30 degrees.

FIG. 2 illustrates a scenario where a door 14 has been opened inward, i.e., within the store. In this example, the door 14 is opened between a specified range of angles, namely 0 degrees to 30 degrees, with respect to reference plane 18. In FIG. 2, controller 22 is now located in a different location within the store, to illustrate that controller 22 need not be in any particular location, provided it is still in communication, via either a wireless or a hard-wired connection, with sensor 20 and antenna 12. In one embodiment, the processor of controller 22 can contain a table listing discrete ranges of door angles, each range corresponding to a particular set of instructions. Upon receipt of the current position of door 14, the processor can determine, based upon the table, how much, if at all, to adjust the magnetic field of antenna 12, and prepare instructions to accomplish this. Note that ranges of angles are for illustration only and that the system 10 of the present invention can be implemented with any suitable range or even with an algorithm that can adjust the interrogation zone on a continuous basis based upon the instant position of door 14.

For example, referring to FIG. 2, if door 14 is swung inward by 25 degrees, either by an entering or an exiting customer, this angle is detected by sensor 20 and a signal is transmitted to controller 22, the signal including information indicating that the door 14 has been opened 25 degrees. Because this angle is within the 0 to 30 degree range, controller 22 may send a signal to antenna 12, instructing it to increase or maintain (depending on the previous setting) the magnetic field to its maximum intensity. Taking into account the size of the store, and the proximity of marked merchandise and registers to the store exit, this might represent a scenario where full detection coverage is desired.

Figure 3:
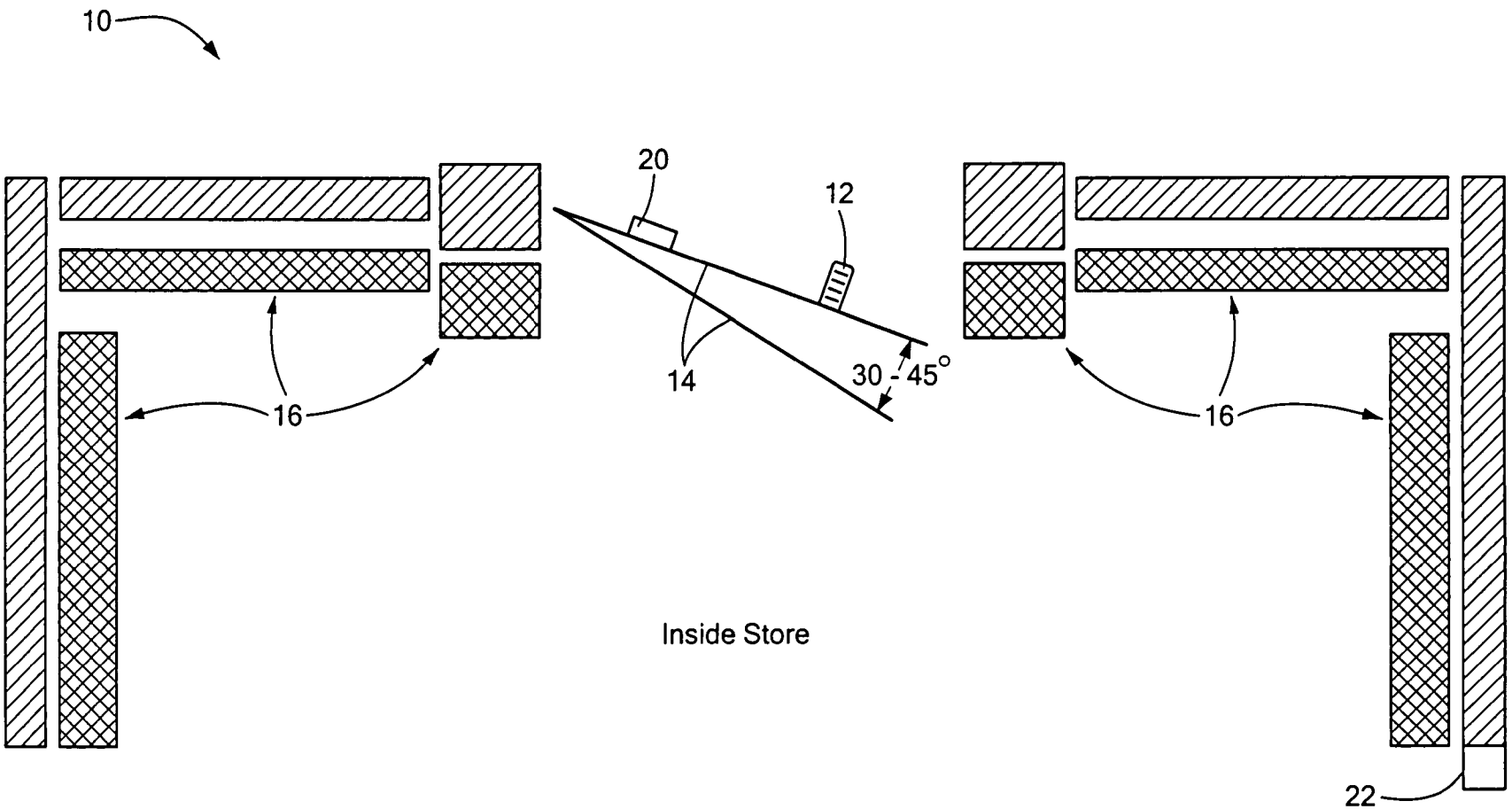
FIG. 3 is a diagram of a door-mounted antenna on a swinging door in accordance with the principles of the present invention, where the door is swung inward at an angle between 30 and 45 degrees.

Referring to FIG. 3, the door 14 has now been swung inward at an angle between 30 and 45 degrees, for example, 40 degrees. Once again, sensor 20 detects the current door angle, transmits a signal with this information to controller 22. In this example, the processor of controller 22 determines that 45 degrees is within the next range of discrete angles, i.e., 30 to 45 degrees, and transmits a signal to antenna 12, instructing it, in one example, to lower the magnitude of its magnetic field, in this case, to one half of its maximum value. This might represent a scenario in which the store does not want to create an over-range condition, where because of the inward motion of the door 14 and antenna 12, an alarm may be triggered because a customer merely waiting on a check-out line has a marked item that has fallen within the "interrogation" zone of the antenna's magnetic field. By cutting the magnitude of the antenna's magnetic field, the interrogation zone is altered and customers may safely wait on a check-out line with a marked item without fear of an alarm being set when a customer opens the door to enter or exit the store, while the interrogation zone still captures marked active items being taken out of the store.

Figure 4:
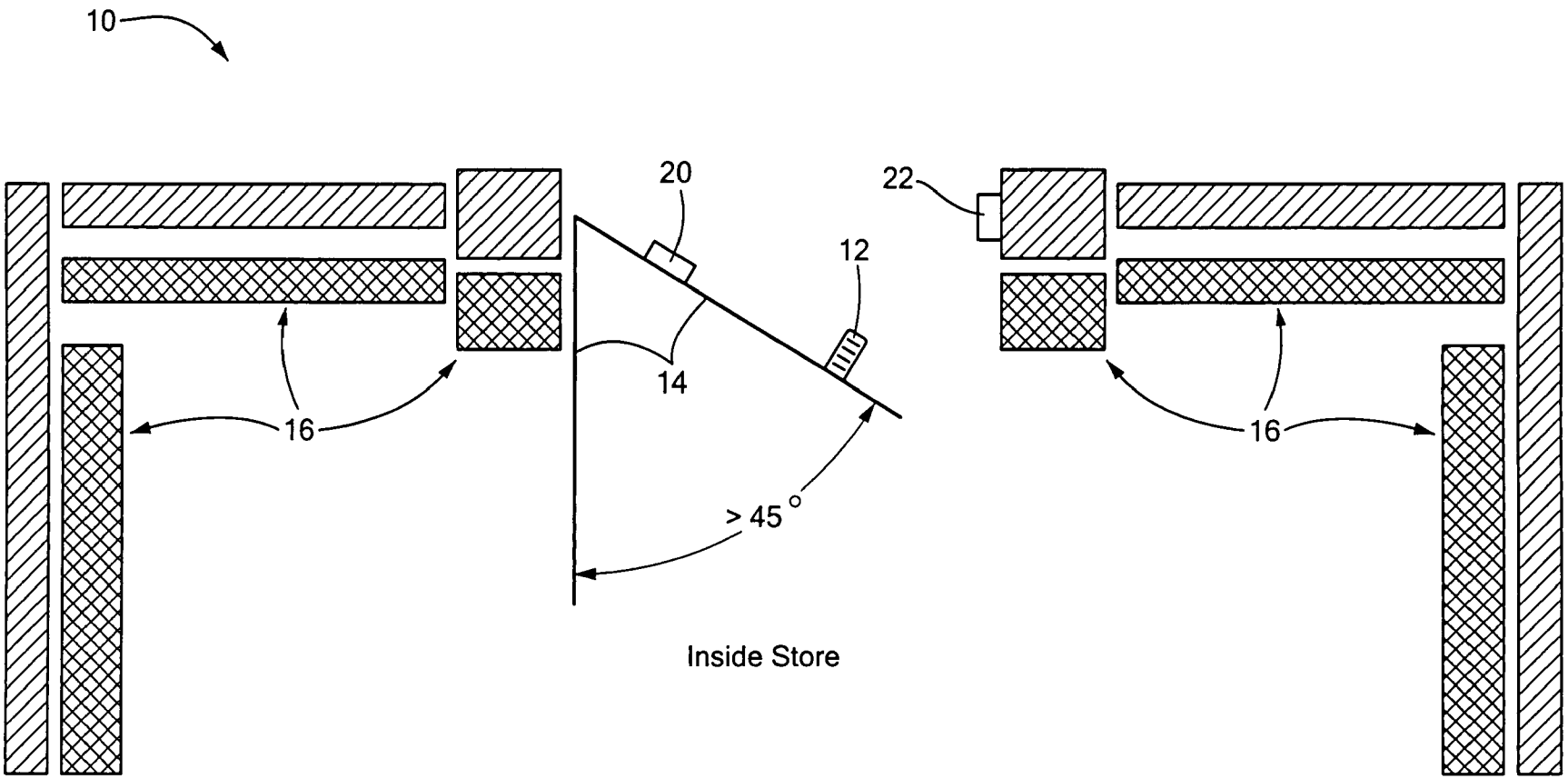
FIG. 4 is a diagram of a door-mounted antenna on a swinging door in accordance with the principles of the present invention, where the door is swung inward at an angle greater than 45 degrees.

In the example illustrated in FIG. 4, door 14 has now been swung inward at an angle of greater than 45 degrees. Because the position of door 14 at this new position may bring the alarm zone of antenna 12 within the signal range of still more marked items within the store, whether on the shelves, or with customers as they stand on a check-out line, it may be desirable to shut the magnetic field emitted by antenna 12 down completely. This may be accomplished in the same fashion as described above. Sensor 20 transmits its positional information to controller 22, which determines an appropriate correction signal, and transmits a corresponding signal to antenna 12, which adjusts its magnetic filed accordingly, in this case shutting it off completely, thus eliminating the interrogation zone.

The above method of instructing antenna 12 to increase, maintain, or decrease the intensity of its magnetic field, is only one method of controlling the size of the interrogation zone utilizing system 10 of the present invention. There are a number of ways that the present invention can alter the scope of the interrogation zone. In one embodiment, as described above, upon receipt of a signal from controller 22 instructing it to increase or decrease the magnitude of its magnetic field, antenna 12 can adjust its transmitter power, thus increasing or decreasing the magnitude of the resulting magnetic field. In another embodiment, the sensitivity of the receiving module of antenna 12 is adjusted. In this embodiment, the intensity of the magnetic field is not altered, but the signals sent by an interrogated marker are received by the antenna's receiver module, the sensitivity of which has been adjusted. Depending upon how much it's sensitivity has been adjusted, the receiver module (or transceiver) of antenna 12 may ignore certain signals received from markers located at a certain location, or ignore all of the signals completely, thus, in effect, reducing or even eliminating the interrogation zone.

In yet another embodiment, a combination of the previous two methods is used to obtain a desired interrogation zone. In still another embodiment, a store alarm, which would normally sound if a marked item falls within the magnetic field of antenna 12, could be disengaged. Thus, for example, rather than transmitting instructions to antenna 12, instructing it to increase the intensity of its magnetic field or adjusting its receiver module sensitivity, controller 22 sends a signal to the alarm device, which disengages the alarm. Thus, in the scenario illustrated in FIG. 4, i.e., when door 14 has been swung inward past 45 degrees, controller 22 may simply disengage the alarm device. The result is the same, e.g., an alarm will not sound when door 14 is opened past 45 degrees.

Figure 5:
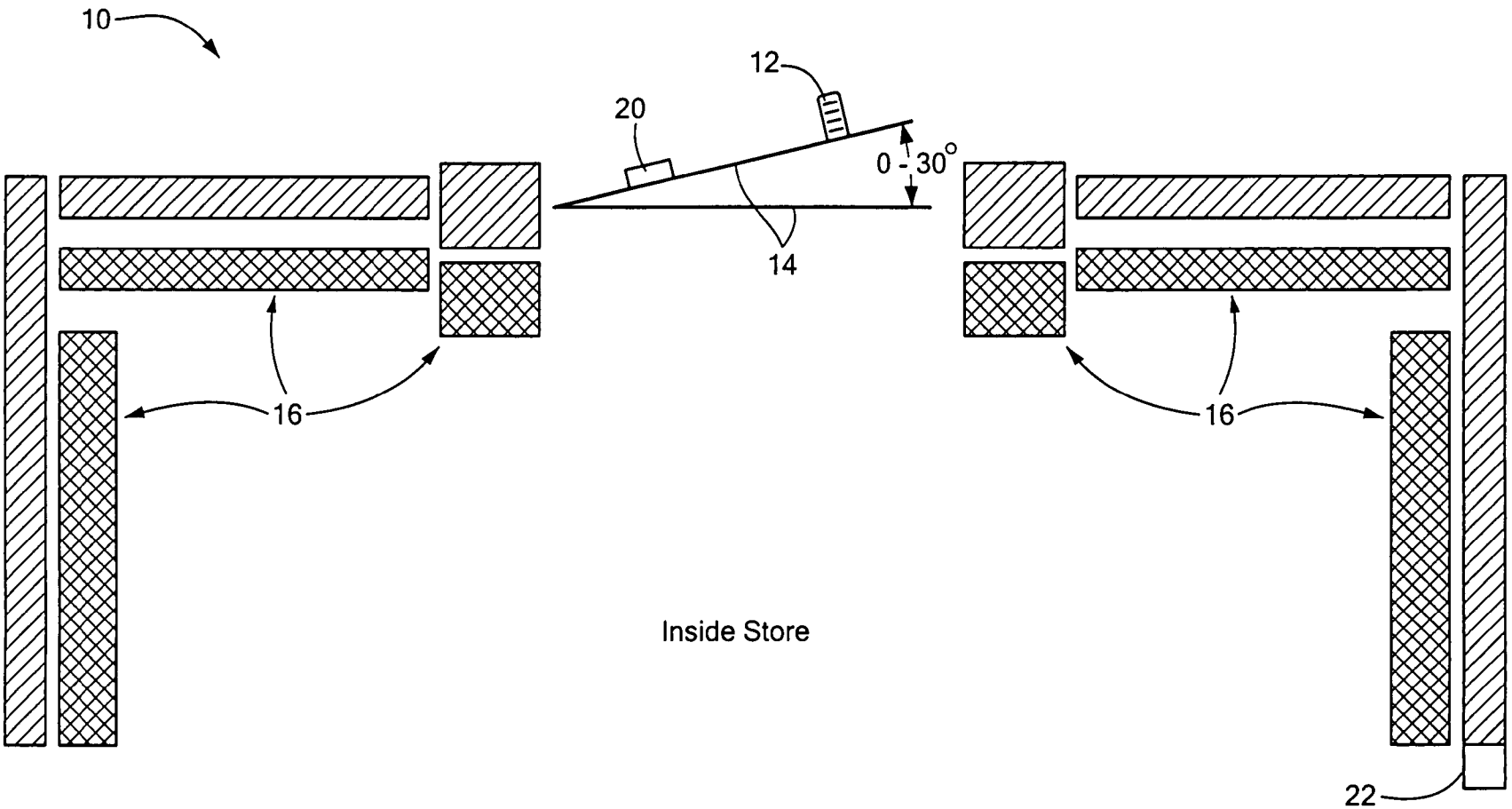
FIG. 5 is a diagram of a door-mounted antenna on a swinging door in accordance with the principles of the present invention, where the door is swung outward at an angle between 0 and 30 degrees.
Figure 6:
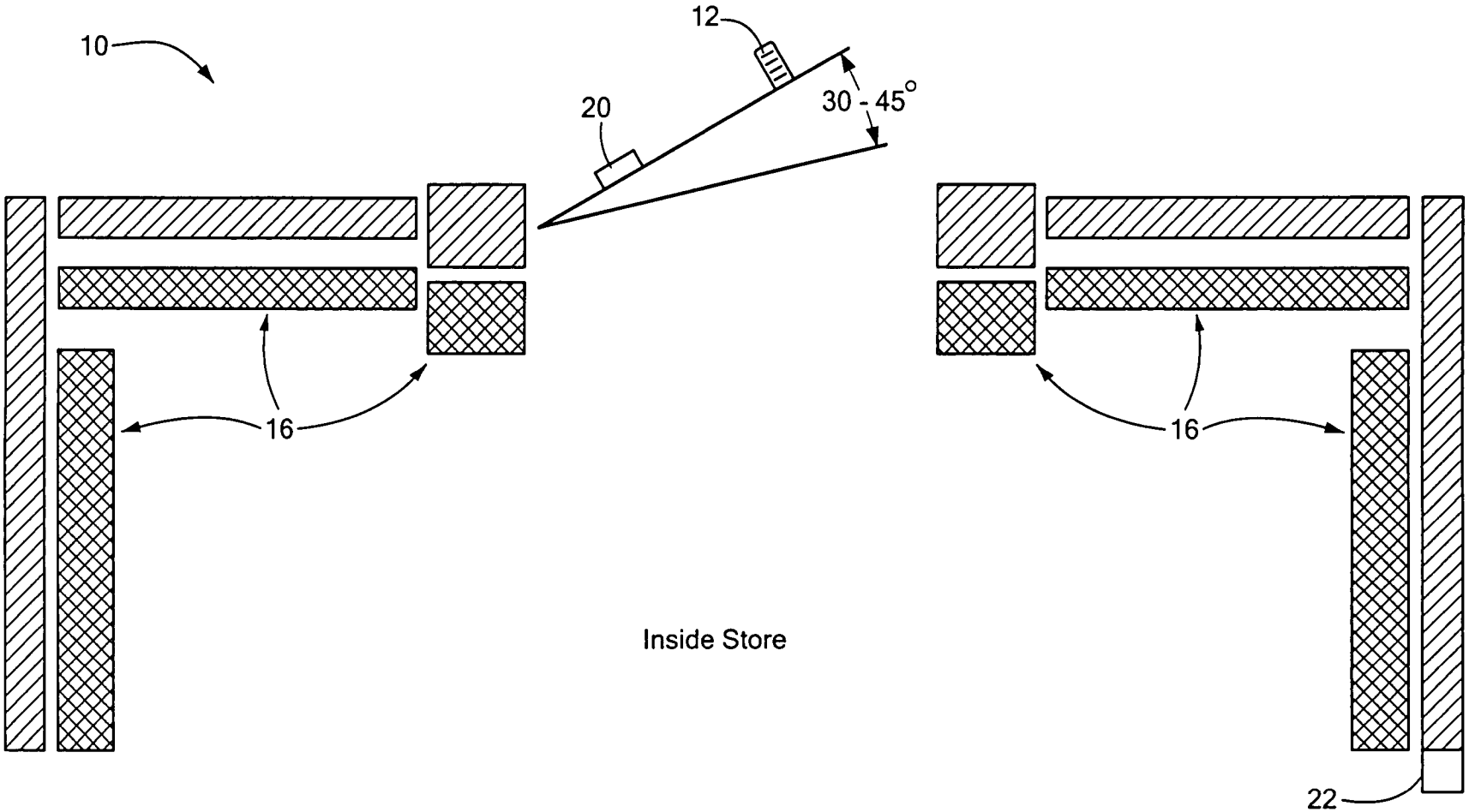
FIG. 6 is a diagram of a door-mounted antenna on a swinging door in accordance with the principles of the present invention, where the door is swung outward at an angle between 30 and 45 degrees.
Figure 7:
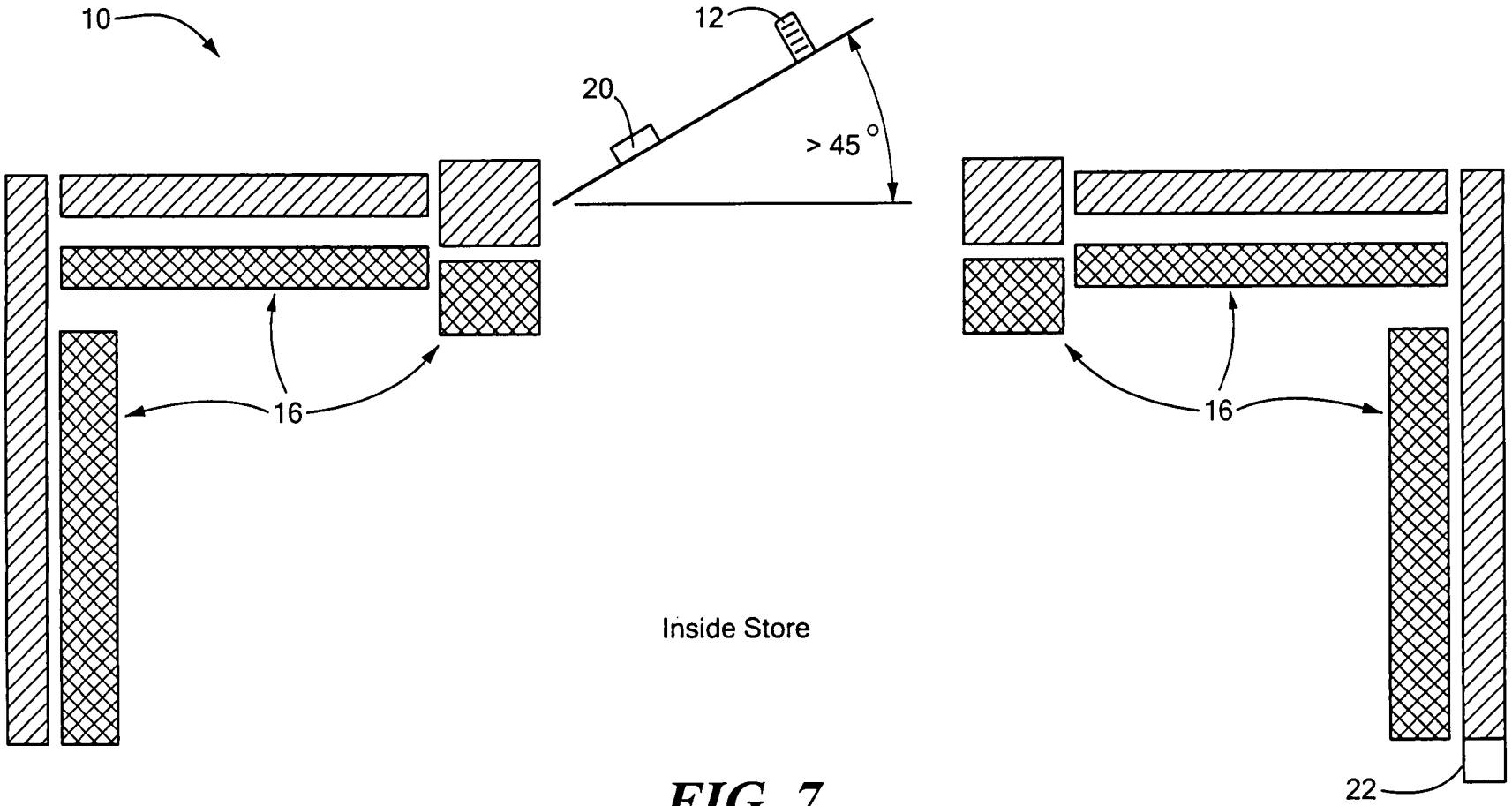
FIG. 7 is a diagram of a door-mounted antenna on a swinging door in accordance with the principles of the present invention, where the door is swung outward at an angle greater than 45 degrees.

FIGS. 2-4 illustrate the occurrence of an over-range condition. A store wants to avoid this scenario since it may trigger alarms in a situation where there is no actual alarm condition, i.e., when a marked item is properly on a shelf or with a customer on a checkout line. FIGS. 5-7 illustrate steps taken by the present invention to prevent the occurrence of an under-range condition. In FIG. 5, door 14 is now being swung outward, away from the store. In this example, a door not opened (0 degrees with respect to reference plane 18) or swung outward up only up to 30 degrees may represent a situation where no interrogation zone is desired. Controller 22, upon receipt of a positional signal from sensor 20, would instruct antenna 12 to decrease or shut down completely the magnetic field, adjust the sensitivity of antenna 12 to basically ignore any signals received from interrogated markers, a combination of both, or deactivate an alarm. It should be noted that the degree ranges and corresponding controller actions provided in this disclosure are illustrative only, and the invention is not limited to any specific values.

In FIG. 6, door 14 is now swung outward at a range of between 30 and 45 degrees with respect to the reference plane 18. It may be desired at this door position to increase the interrogation zone to its maximum amount. Thus, upon receipt of the positional signal from sensor 20, controller 22 can transmit a signal to antenna 12, instructing it to increase or maintain (depending upon its previous state) the magnetic field to its maximum level, instructing it to adjust the receiver module sensitivity, or a combination of both. In the alternate, controller 22 can simply deactivate the store's alarm device. Should door 14 be swung even further in an outward direction, as shown in FIG. 7, it may be desired to maintain the magnetic field at a maximum intensity, reduce it by a certain amount, or shut it off completely. This may be accomplished in one of several ways described above.

Figure 8:
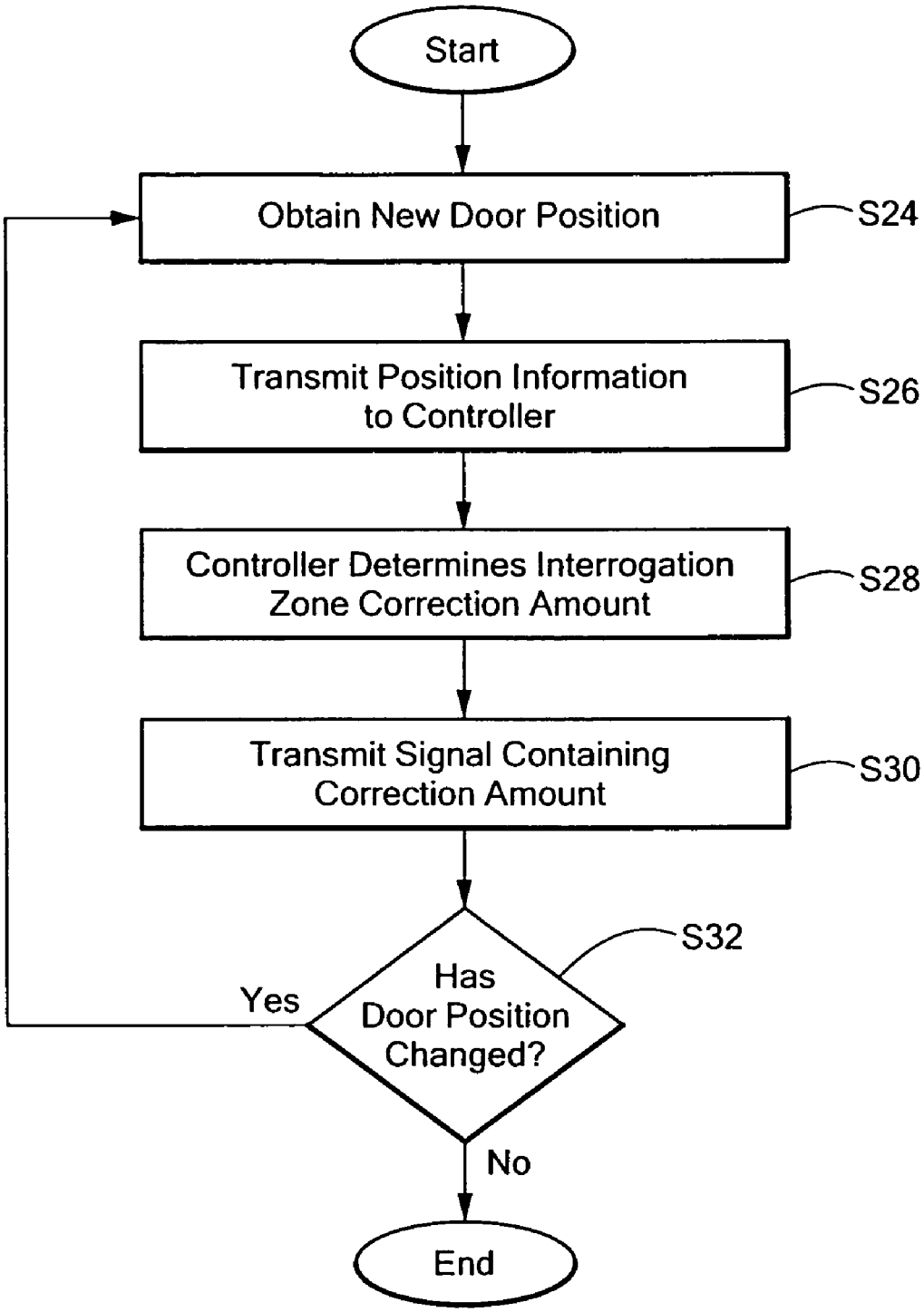
FIG. 8 is a flowchart illustrating the process taken by an embodiment of the present invention.

FIG. 8 is a flowchart illustrating the steps taken by the present invention in order to control the magnetic field radiated by a door-mounted antenna 12. In step S24, sensor 20 detects the angle or door 14 with respect to reference plane 18, and transmits this information to controller 22, via step S26. Controller 22 then determines an interrogation zone correction amount, if any, by comparing the current angle of door 14 with a table of stored rules, via step S28. Controller 22 then transmits a signal, via step S30, to either antenna 12, instructing it to alter its magnetic field or to adjust the sensitivity of its receiver module, or to an alarm device, deactivating the alarm device. If sensor 20 determines that the location of door 14 has changed, via step S32, sensor 20 detects the new door location via step S24, and repeats the above process.

The present invention is equally adaptable to sliding doors rather than swinging doors. A sensor 20 may be used in the same way, i.e., sensor 20 detects door movement with respect to a reference point or plane 18. Thus it is not needed to determine if door 14 is being swung outward or inward, but merely that is has moved in a particular direction. Therefore, in this embodiment, an angle position sensor is not needed. A linear position sensor 20 can be used to monitor and determine when door 14 has moved from its previous position.

The present invention can also utilize a sensor 20 that determines the speed in which door 14 is moved. Thus, instead of or in addition to sensor 20 determining the relative position that door 14 has moved in relation to a reference point or plane 18, a sensor 20 can be used to determine the speed of door motion. If, for example, door 14 opens very quickly, it may be the indication that someone is trying to exit the store without paying for marked merchandise. In this instance, the interrogation zone may be quickly increased to its maximum size and area. Various scenarios can be contemplated that utilize one or more sensors, each measuring a particular feature of the door, i.e. its relative position and/or its speed or movement. This information is transmitted to controller 20, which determines if corrective action, with respect to the interrogation zone, needs to be taken.

In another embodiment, the sensor 20 is replaced by an on/off switch. The switch can determine if, for example, door 14 has past a certain point, at which time it signals controller 22, which, in turn, signals antenna 12 to deactivate. In still another embodiment, system 10 is only activated upon the opening (or closing) of door 14.

The present invention therefore advantageously provides a system and method which allows establishments to tailor the EAS or RFID system to its particular needs. Particularly, the invention takes into account the size of the store, and the proximity of marked merchandise and check-out counters in relation to exit doors, and creates a dynamic controlled system that can alter the interrogation zone as conditions change, i.e., as exit doors are opened and closed.

The present invention can be realized in hardware, software, or a combination of hardware and software. An implementation of the method and system of the present invention can be realized in a centralized fashion in one computer system or in a distributed fashion where different elements are spread across several interconnected computer systems. Any kind of computer system, or other apparatus adapted for carrying out the methods described herein, is suited to perform the functions described herein.

Significantly, this invention can be embodied in other specific forms without departing from the spirit or essential attributes thereof, and accordingly, reference should be had to the following claims, rather than to the foregoing specification, as indicating the scope of the invention.

We claim:

1. A method of controlling an interrogation zone of a door-mounted antenna, the antenna having a transmitter component for radiating an electromagnetic field and a receiver component for receiving signals from a marker, the method comprising: monitoring movement of a door upon which the antenna is mounted; determining a distance that the door is moved in relation to a reference plane; providing interrogation zone modification instructions based upon the distance that the door has been moved in relation to the reference plane; and wherein monitoring the movement of a door upon which the antenna is mounted is performed by a sensor located proximate the door, the sensor determining if the door has been moved a threshold distance with respect to the reference place and if the threshold distance has been attained, altering the interrogation zone.

2. The method of claim 1, wherein the instructions include adjusting the power of the antenna transmitter component.

3. The method of claim 1, wherein the instructions include adjusting the sensitivity of the antenna receiver component.

4. The method of claim 1 wherein the instructions include both adjusting the power of the antenna transmitter component and adjusting the sensitivity of the antenna receiver component.

5. The method of claim 1, wherein the instructions include disabling an alarm device.

6. The method of claim 1, further comprising monitoring the speed at which the door moves in relation to the reference plane.

7. The method of claim 6, wherein the modification instructions are dependent upon the speed that the door moves with respect to the reference plane.

8. The method of claim 1, wherein monitoring movement of the door upon which an antenna is mounted includes determining if the door is swung outward or inward with respect to the reference plane.

9. The method of claim 1, wherein determining the distance that the door is moved in relation to the reference plane is performed by an angle position sensor mounted on the door.

10. The method of claim 1, wherein altering the interrogation zone includes preventing radiation of the electromagnetic field from the antenna.

11. The method of claim 1, further comprising:

identifying ranges of discrete door movement distances; and assigning instructions to each range.

12. The method of claim 1, wherein the antenna and the marker comprise an EAS interrogation system.

13. The method of claim 1, wherein the antenna and the marker comprise an RFID interrogation system.

* * * * *